United States Patent [19]

Rothenbuhler et al.

[11] 4,430,652

[45] Feb. 7, 1984

[54] REMOTE CONTROL SYSTEM

[75] Inventors: Dan E. Rothenbuhler, Acme; Galen A. Biery, Jr., Bellingham, both of Wash.

[73] Assignee: Rothenbuhler Engineering Co., Sedro-Woolley, Wash.

[21] Appl. No.: 325,016

[22] Filed: Nov. 25, 1981

[51] Int. Cl.[3] ..... G08C 19/00

[52] U.S. Cl. ..... 340/825.69; 340/825.72; 340/825.57; 340/825.64; 340/870.21; 340/870.24; 375/23; 375/95; 212/160

[58] Field of Search ..... 340/825.69, 825.72, 340/825.6, 825.63, 825.64, 825.65, 825.57, 825.58, 825.75, 539, 870.19, 870.24, 870.23, 870.21, 870.2, 870.22; 375/23, 22, 25, 69, 75, 95, 96, 94; 370/8-9; 455/38, 70, 603; 212/160; 214/DIG. 2

[56] References Cited

U.S. PATENT DOCUMENTS

| | | | |
|---|---|---|---|
| 4,038,590 | 7/1977 | Knowlton | 340/825.69 |
| 4,178,549 | 12/1979 | Ledenbach et al. | 340/825.69 |
| 4,197,525 | 4/1980 | Biery et al. | 340/825.65 |

*Primary Examiner*—Donnie L. Crosland

*Attorney, Agent, or Firm*—Christensen, O'Connor, Johnson & Kindness

[57] ABSTRACT

A remote control system capable of utilizing manually encoded signals is disclosed. The system is particularly suitable for use in the logging industry because it is capable of utilizing standardized whistle signals for both remove control and audible signalling purposes. The system includes a transmitter for transmitting a manually encoded signal. The control signal is received by a receiver and is decoded by a decoder that reduces the manually encoded signal to a digitized signal. The digitized signal is compared with a set of reference digitized signals, and if a match is found, a corresponding output control signal is applied to a controlled device such as a yarder.

20 Claims, 11 Drawing Figures

| | |
|---|---|
| POINTER BEGINNING | 1st PULSE COUNT |
| | 1st SPACE COUNT |
| | 2nd PULSE COUNT |
| | 2nd SPACE COUNT |
| | 3rd PULSE COUNT |
| | 3rd SPACE COUNT |

| | | | | | | | | |
|---|---|---|---|---|---|---|---|---|
| REF 1 | 0 | 0 | 0 | 1 | 0 | 1 | 1 | 0 |
| REF 2 | 0 | 0 | 0 | 0 | 0 | 0 | 1 | 0 |
| NUMBER | 0 | 0 | 0 | 1 | 0 | 0 | 0 | 0 |

TABLE ENTRIES

| | | | | | | | | | |
|---|---|---|---|---|---|---|---|---|---|
| FIRST OUTPUT CONTROL SIGNAL | 1st REF. PULSE WORD | 0 | 0 | 0 | 1 | 0 | 1 | 1 | 0 |
| | 1st REF. SPACE WORD | 0 | 0 | 0 | 0 | 0 | 0 | 1 | 0 |
| | 1st REFERENCE NUMBER | 0 | 0 | 0 | 1 | 0 | 0 | 0 | 0 |
| | 1st INSTRUCTION ADDR. | 0 | 0 | 0 | 1 | 1 | 0 | 0 | 0 |
| SECOND OUTPUT CONTROL SIGNAL | 2nd REF. PULSE WORD | 0 | 0 | 0 | 0 | 1 | 1 | 0 | 0 |
| | 2nd REF. SPACE WORD | 0 | 0 | 0 | 0 | 0 | 1 | 0 | 0 |
| | 2nd. REF. NUMBER | 0 | 0 | 0 | 0 | 1 | 0 | 0 | 0 |
| | 2nd INSTRUCTION ADDR. | 0 | 1 | 0 | 0 | 1 | 0 | 0 | 1 |

REMOTE CONTROL SYSTEM

FIELD OF THE INVENTION

The present invention is generally related to remote control systems and, more particularly, to remote control systems that utilize manually encoded signals which are decoded to provide corresponding output control signals and to execute predetermined control functions.

BACKGROUND OF THE INVENTION

The logging industry is one area in which the use of manually encoded signals has evolved extensively. Such signals are known in the trade as whistle signals and are employed as a means of communication between workers in the field. As the name implies, the signals consist of predetermined sequences of long and short whistle blasts produced by a whistle, horn, or other audible signalling device. Typically, the audible signalling device is remotely actuated by radio-frequency (RF) signals from a manually actuated transmitter held by a worker. Each signal represents a specific instruction from one worker to another and usually pertains to the operation of a specific type of machinery. For example, standardized whistle signals are used to indicate a desired operation of yarding lines and associated yarders used in yarding operations.

In addition to communicating instructions from one worker to another, whistle signals serve an important safety function in alerting other workers in the vicinity of immediately impending changes in the operation of the machinery. In this regard, workers in the logging industry are cognizant of the standardized whistle signals and rely on such signals for forewarning of changes in the operation of the machinery. In recognition of this safety aspect of the use of whistle signals, various states and regulatory agencies have promulgated laws and regulations mandating the use of standardized whistle signals in logging operations.

In recent years the advantages of remote control systems, usually radio control systems, have become apparent in the logging industry. The advent of such systems has been complicated, however, by the necessity of adhering to the use of manually generated, standardized whistle signals for indicating the desired operations of logging machinery. Although there are various well known types of remote control systems that could be adapted to provide remote control of logging equipment, there has not been previously available a remote control system having a coding scheme based on standard whistle signals. In large part this is due to the fact that the whistle signals are manually generated and are thus subject to some variation from one worker to another, as well as variation in a given signal when produced at different times by an individual worker. For example, there may be significant variation in duration of the individual whistle blasts making up the signal, as well as variation in the durations of the intervening pauses, or spaces, between whistle blasts. Also, there may be a significant variation in the relative lengths of long and short whistle blasts, as well as variations in the relative durations of the intervening long and short spaces. Although such variation does not ordinarily pose any problem with respect to communication and understanding between workers in the field, who compensate for such variation as a matter of course, it has heretofore prevented the implementation of a remote control system having a coding scheme based on manually generated whistle signals.

Accordingly, it is an object and purpose of the present invention to provide an apparatus for utilizing manually encoded signals in a remote control system. More specifically, it is an object of the invention to provide an apparatus for utilizing manually encoded whistle signals in a remote control system for use in the logging industry.

It is also an object to achieve the foregoing objects in a remote control system wherein signals are manually encoded according to a predetermined coding scheme, and wherein such signals are decoded to execute predetermined control functions.

It is another object of the invention to provide a remote control system wherein manually encoded signals are decoded to execute predetermined control functions, and wherein the manually encoded signals are also utilized to produce audible signals that represent and serve to announce the control functions being executed.

These and other objects will be apparent on consideration of the ensuing description of the invention and the accompanying drawings.

SUMMARY OF THE INVENTION

In accordance with the present invention, a remote control system includes a transmitting means for transmitting a manually encoded signal consisting of a sequence of pulses and interpulse spaces, a receiving means for receiving the signal, and a decoding means for decoding the received signal and applying a corresponding output control signal to a controlled device. The decoding means includes first means for measuring the durations of the pulses as well as the durations of the interpulse spaces. The decoding means further includes second means for digitizing the pulse and space durations by comparing the durations of successive pulses and discriminating between long and short pulses and by likewise comparing the durations of successive spaces and discriminating between long and short spaces, to thereby produce a digital representation of the manually encoded signal. Finally, the decoding means includes a third means for correlating the digital representation with a plurality of reference digital representations each corresponding to one of a plurality of predetermined output control signals and for selecting one of the output control signals upon determination of a match between the digital representation and one of the reference digital representations, and fourth means for supplying the selected output control signal to the controlled device.

In a preferred embodiment of the invention, the first means, second means and third means are incorporated in a digital computer that executes the timing, digitizing and correlating functions in accordance with a predetermined computer program. In such an embodiment, the digital representation includes one or more digital words and each reference digital representation includes one or more corresponding reference digital words. If a match is found between the word or words in the digital representation and the word or words in a reference digital representation, the decoding means selects the corresponding output control signal and supplies that signal to the controlled device.

In accordance with another aspect of the invention, pulses are determined to be either long or short by comparing the duration of each pulse with the average duration of the longest and shortest pulses, and spaces are likewise determined to be either long or short by comparing the duration of each space with the average duration of the longest and shortest spaces.

In another aspect of the invention, all of the pulses are first compared to determine if the duration of the longest pulse is greater than the duration of the shortest pulse by more than a predetermined amount, for example, by a factor of two. If the longest pulse is not greater than the shortest pulse by more than such an amount, it is assumed that all pulses are short pulses and the system decodes the signal accordingly. If the longest pulse is longer than the shortest pulse by more than the predetermined amount, then the longest and shortest pulse durations are averaged and the pulses are evaluated as being either long or short, as noted above. This procedure effectively takes into account the substantial difference in average pulse lengths commonly observed in manually encoded signals consisting of a sequence of like pulses.

These and other aspects and advantages of the invention will become more apparent on consideration of the following detailed description of a preferred embodiment and the accompanying figures.

DETAILED DESCRIPTION OF THE PREFERRED EMBODIMENT

Figure 1:
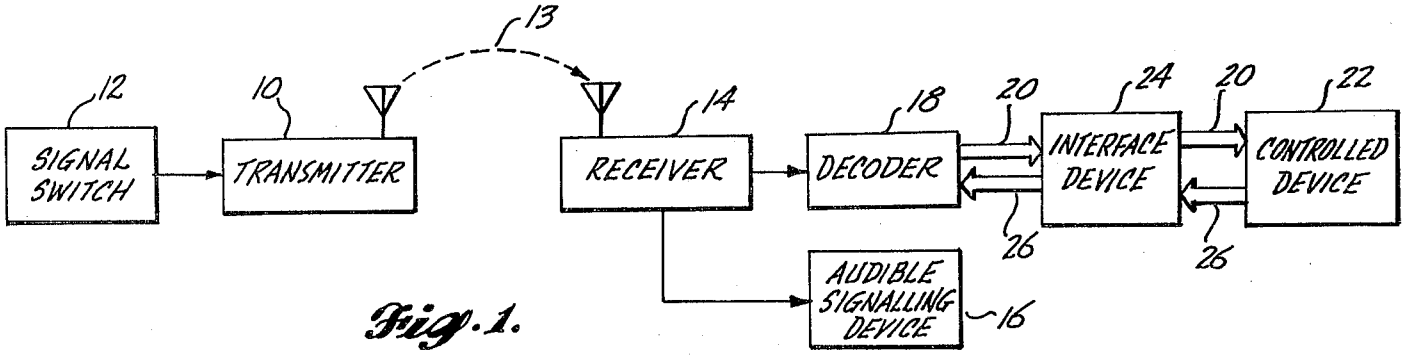
FIG. 1 is a schematic block diagram of a preferred embodiment of the remote control system of the present invention including a decoder.

Referring to FIG. 1, a preferred embodiment of the remote control system includes a transmitter 10 that is actuated by a signalling switch 12 so as to emit a manually encoded signal 13 modulated in an appropriate manner on a RF carrier. Signal 13 is received by a receiver 14 that demodulates the manually encoded signal and applies it to both an audible signalling device 16 and to a decoder 18. Preferably, the transmitter and the receiver are constructed so as to provide modulation and demodulation of the manually encoded signal by means of a scheme known as "two-tone sequential" as disclosed in U.S. Pat. No. Re. 27,044, reissued Feb. 2, 1971 to Rothenbuhler et al. and in U.S. Pat. No. 4,197,525, issued Apr. 8, 1980, to Biery et al., both of which are assigned to the assignee of the present invention and both of which are hereby incorporated by reference.

The audible signalling device 16 produces an audible "whistle" signal that corresponds to the manually encoded signal. Ordinarily, the receiver 14 and the decoder 18, and possibly also the signalling device 16, are incorporated in a single receiving unit, although they are illustrated separately for the purpose of this description. The decoder 18 decodes the received, manually encoded signal and applies a predetermined output control signal 20 to a controlled device 22 through an interface device 24. Controlled device 22 may consist of any one of various types of machinery that may be advantageously remoted controlled, for example, a yarding line assembly. In FIG. 1, the output control signal 20 is represented by a wide arrow to indicate that there are multiple connections between the decoder 18 and the controlled device 22 through the interface device 24, with the decoder 18 actuating various functions of the controlled device 22 depending on the particular encoded signal received. A second wide arrow 26 represents a set of feedback connections between the controlled device 22 and the decoder 18 through the interface device 24, which feedback connections provide signals to the decoder that positively indicate the states of the various functions under remote control.

Figure 2:
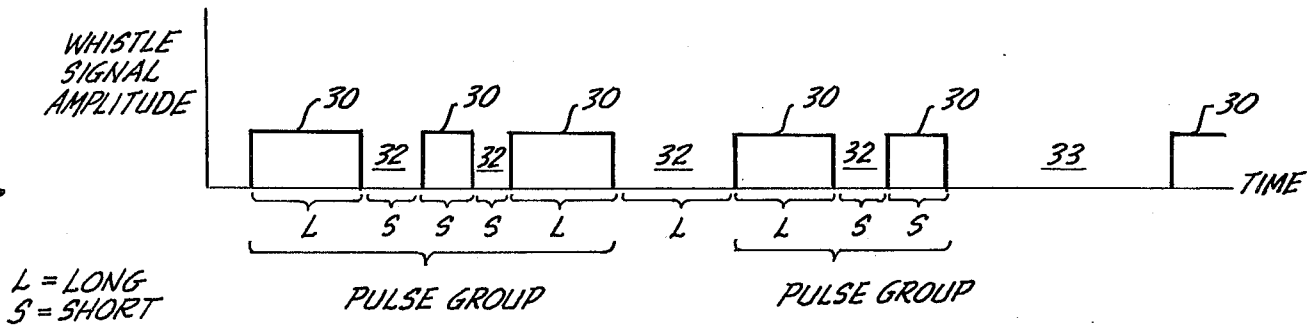
FIG. 2 is a schematic illustration of an exemplary manually encoded signal.

The signalling switch 12 may be a simple spring-biased ON/OFF switch that is selectively opened and closed so as to cause the transmitter 10 to produce a manually encoded signal such as that represented schematically in FIG. 2. Such a signal consists of a sequence of pulses 30 that are separated by intervening spaces 32. For a time corresponding to the duration of each pulse, the audible signalling device 16 is actuated to produce a whistle blast, and for a time corresponding to the duration of each space, the audible signalling device 16 is deactuated and therefore silent. The durations of both the pulses 30 and spaces 32 are variable. In accordance with the standard system of whistle signals used in the logging industry, the pulses 30 are either short or long in duration, and the spaces 32 are likewise either short or long. The long spaces correspond generally to pauses between groups of pulses, whereas the short spaces generally correspond to the spacing between pulses in each pulse group. Termination of the whistle signal is signified by an excessively long space 33 (whose duration is greater than that of any of the interpulse spaces 32) following any of pulses 30.

The durations of both the pulses 30 and the spaces 32 are ordinarily somewhat variable due to the fact that they are manually generated and thus subject to human variation in their timing. The decoding of such a signal, notwithstanding the variability in pulse and space durations, is accomplished by the decoder in a manner described more fully below.

Figure 3:
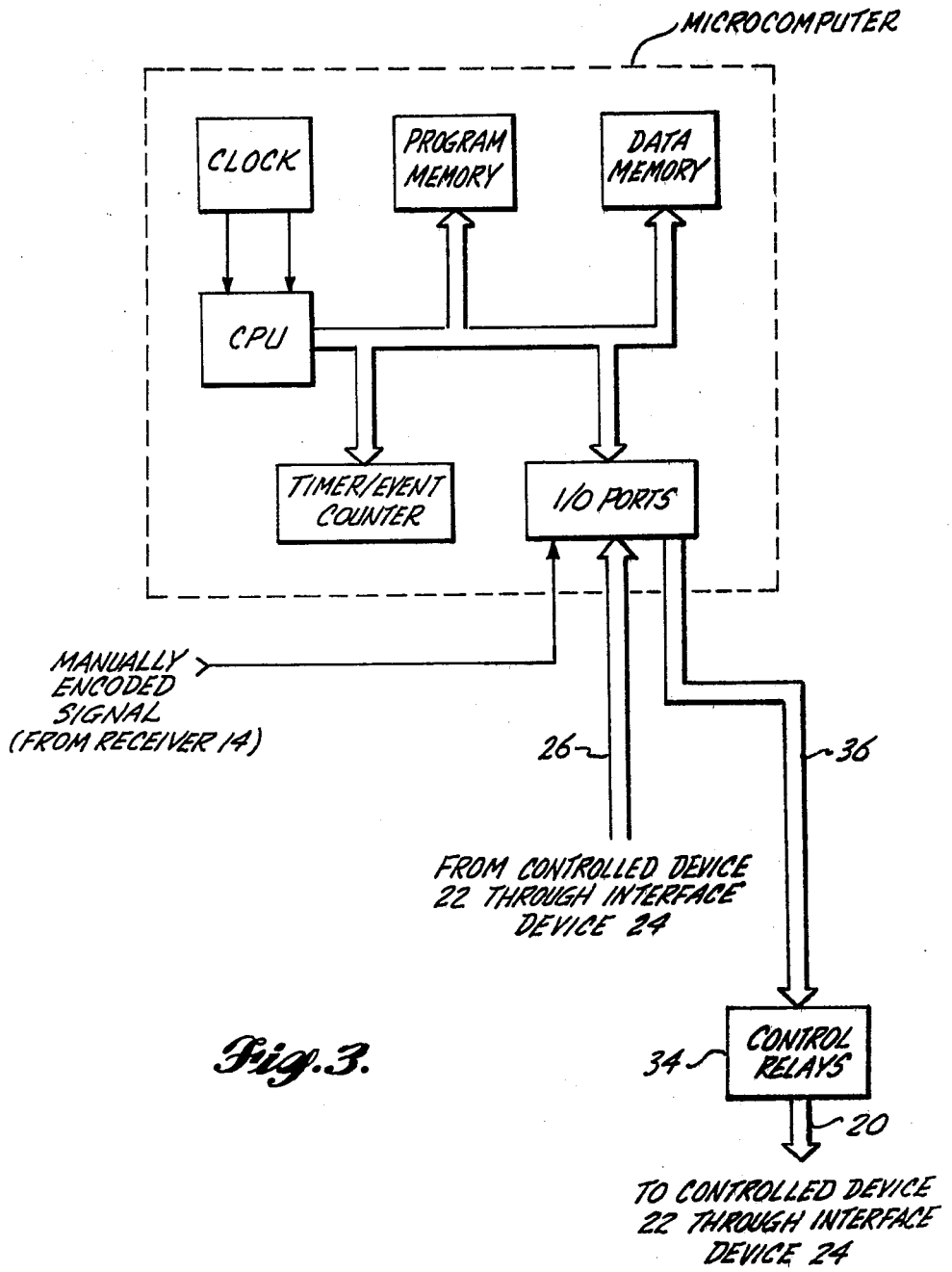
FIG. 3 is a block diagram of the decoder.

In the preferred embodiment, the decoder 18 includes a suitably programmed digital computer such as the eight-bit, single-chip microcomputer sold by Intel Corporation of Santa Clara, Calif. and identified by the Model No. 8748. Details regarding the operation and programming of the 8748 microcomputer are set forth in a user's manual published by Intel Corporation in 1978 under the title "MCS-48 Microcomputer User's Manual". With reference now to FIG. 3, the decoder of the preferred embodiment includes a single-chip microcomputer that consist of a clock, a CPU, a program memory, a data memory, a timer/event counter, and a plurality of I/O ports. The clock provides appropriate clock signals to the CPU, and the CPU, the program memory, the data memory, the timer/event counter, and the I/O ports are interconnected by appropriate data and address buses and appropriate control lines. A set of program instructions required for the operation of the decoder is stored in the program memory (and decribed hereinafter with reference to FIGS. 4, 5A, 5B, 6A and 6B) and all data storage and computations are carried out in the data memory (with a portion of the data memory being described hereinafter with reference to FIGS. 7, 8 and 9). The manually encoded signal from receiver 14 is provided to the microcomputer through the I/O ports, as are the signals on feedback connections 26 from the controlled device 22 through interface device 24. The I/O ports are also connected to a plurality of control relays 34 by interconnections 36, and the signals on interconnections 36 cause control relays 34 to assume various states so as to provide output control signal 20 (in the form of relay contact closures) to the controlled device 22 through interface device 24.

Figures 4, 7, 8, 9:
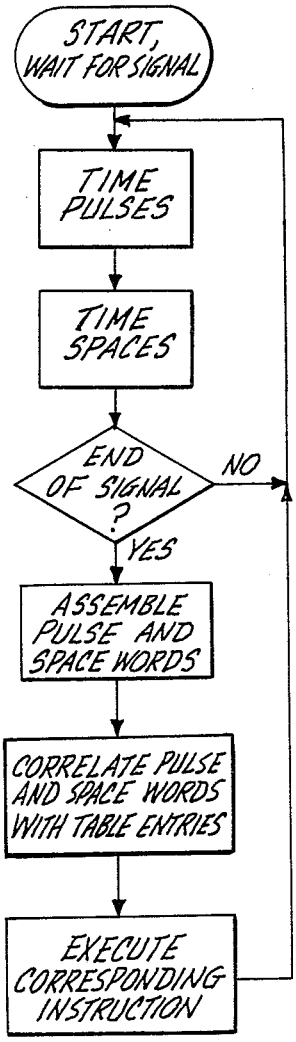
FIG. 4 is a simplified flow chart illustrating the sequential operation of the remote control system while under computer program control.
FIG. 7 is a schematic representation of memory locations in the decoder used for storage of count data representing the duration of successive pulses and spaces in the manually encoded signal.
FIG. 8 is a schematic representation of REF 1 and REF 2 memory locations in the decoder and a NUMBER register in the decoder which contain a digital representation of the manually encoded signal in FIG. 2; and, FIG. 9 is a schematic representation of a table in memory in the decoder which contains a plurality of reference digital representations each corresponding to a predetermined output control signal from the remote control system.

FIG. 4 is a simplified flow chart illustrating the operation of the decoder 18 under program control. Upon start-up of the decoder, the microcomputer places all control relays 34 in a desired initial state. The microcomputer then waits for a signal from receiver 14. Upon receipt of a signal, the durations of the pulses 30 and the intervening spaces 32 are successively measured. Upon detection of the end of a whistle signal, the measured durations of the pulses and spaces are digitized into short and long pulses and spaces, and corresponding digital words are assembled. The digital words are compared with entries in a look-up table in the data memory until a match is found. Upon finding a match, the microcomputer executes corresponding instructions on the basis of an address located in the look-up table by causing control relays 34 to assume those states representing the output control signal required for the whistle signal.

Figure 5A:
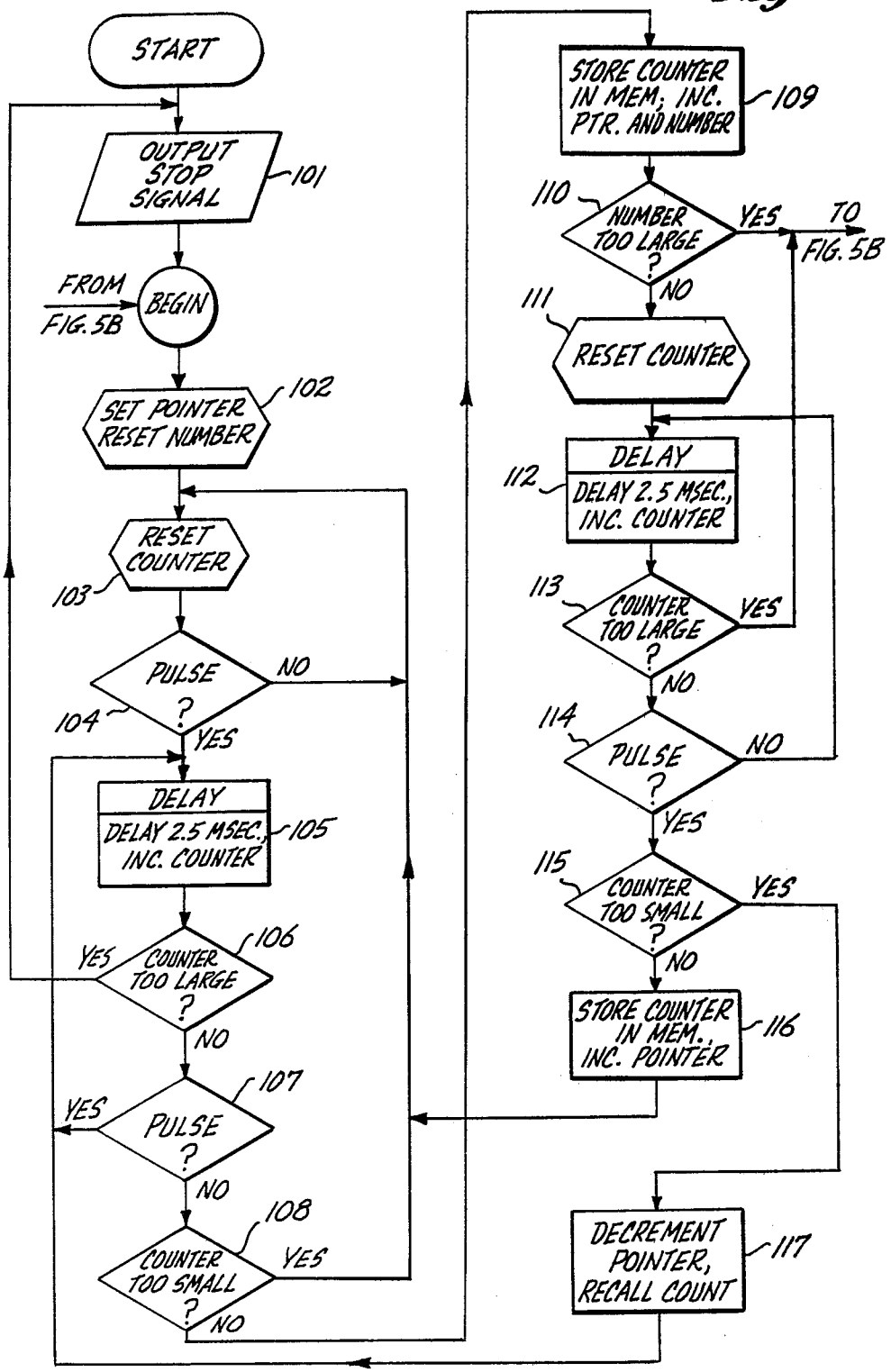
FIGS. 5A–5B are a more detailed flow chart of the operation of the decoder under main program control.
Figure 5B:
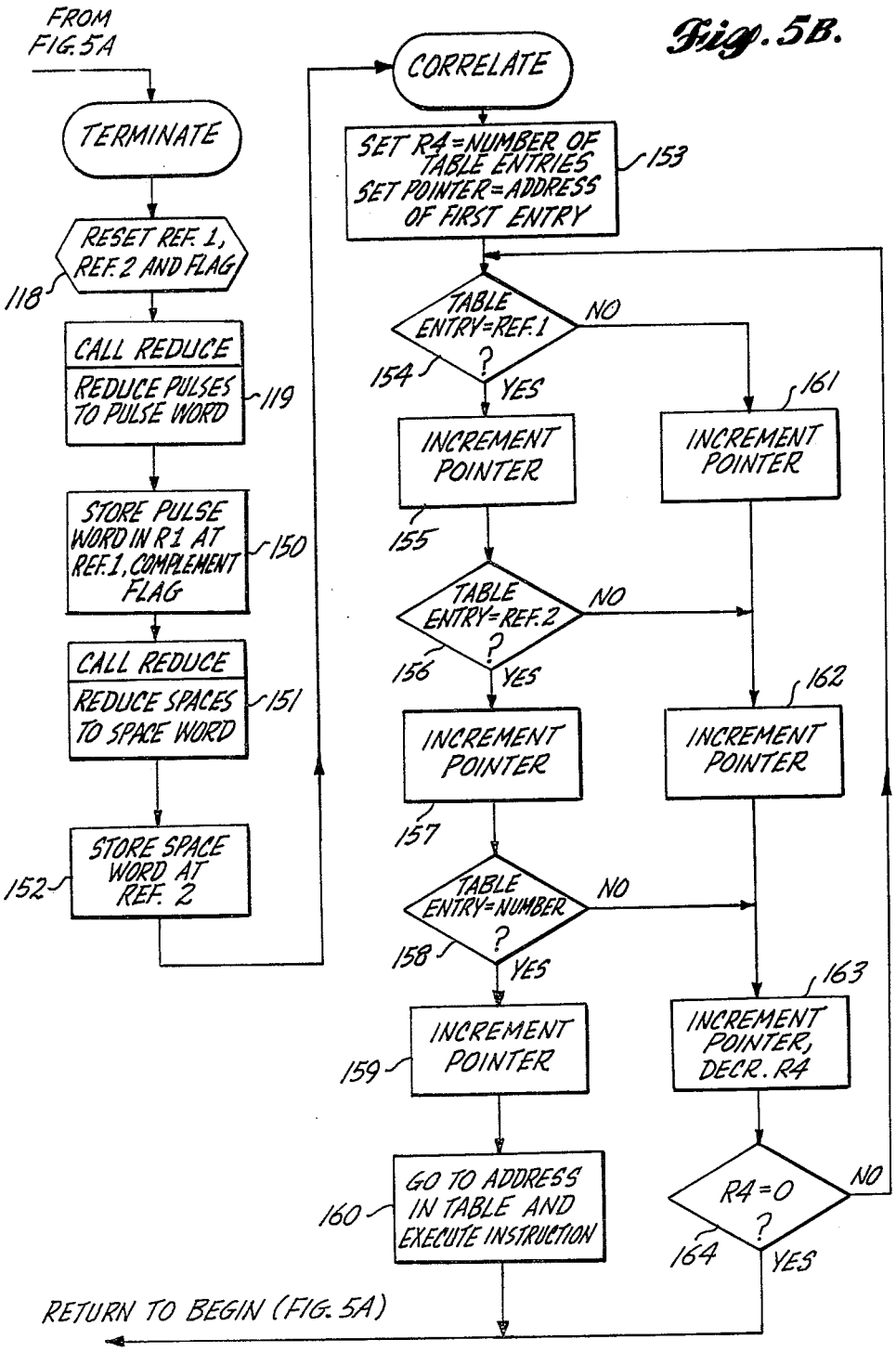
Figure 6A:
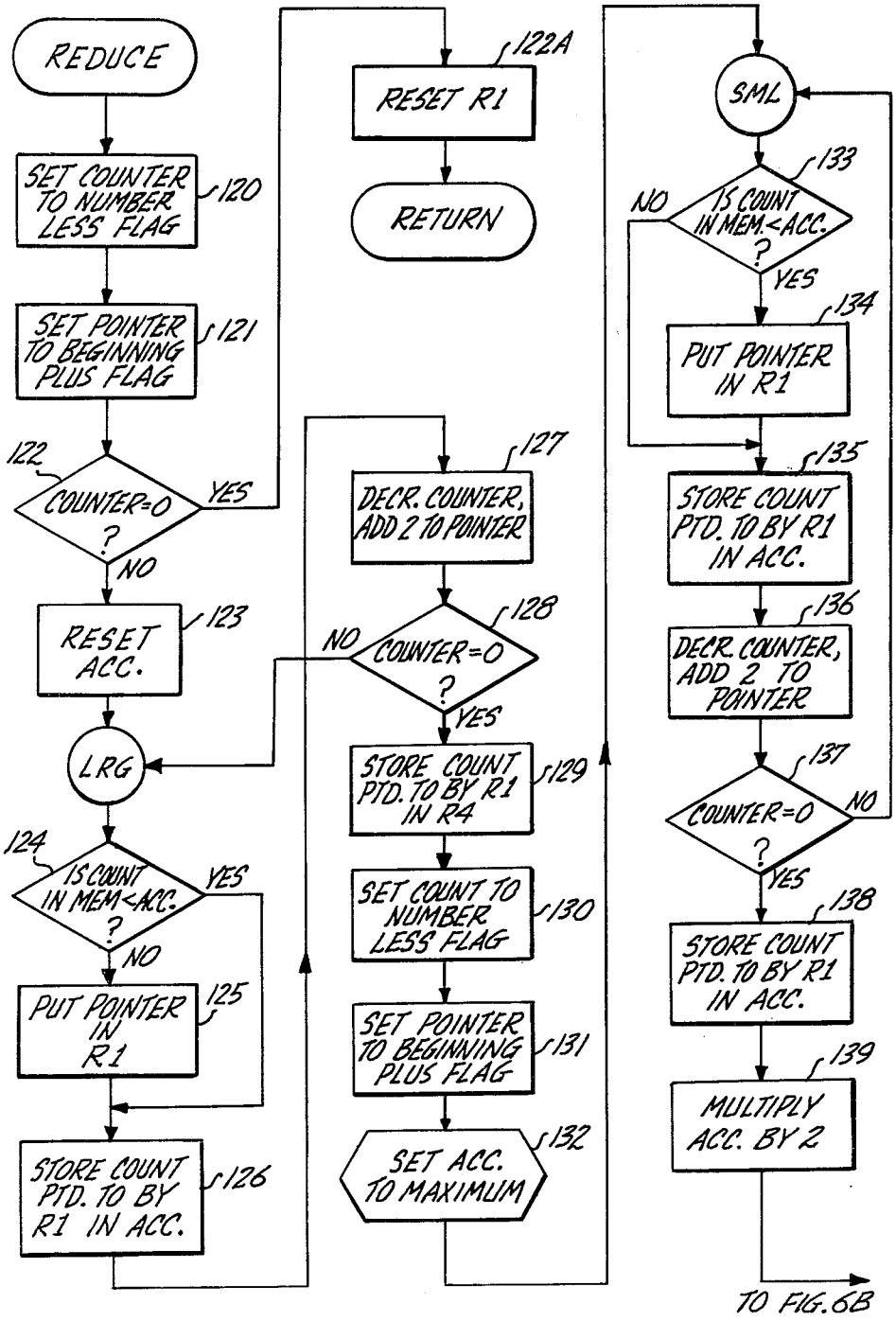
FIGS. 6A–6B are a flow chart illustrating the operation of the decoder while under control of a REDUCE subroutine.
Figure 6B:
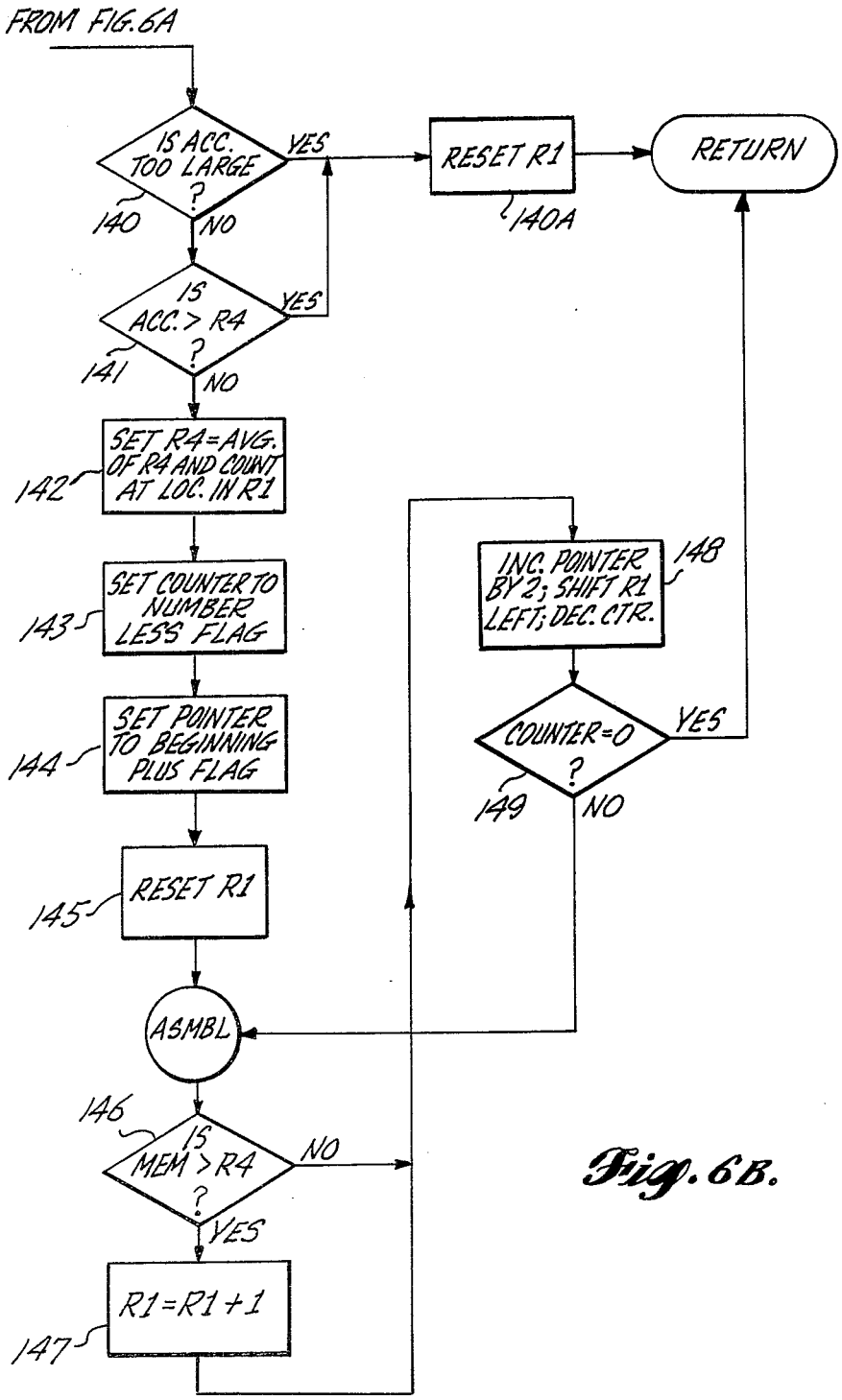

A more detailed flow chart is set forth in FIGS. 5A–5B and 6A–6B. Briefly, FIGS. 5A–5B illustrate the operation of the decoder under main program control, whereas FIGS. 6A–6B illustrate the operation of the decoder under control of a major subroutine entitled REDUCE. Referring to FIG. 5A, upon start-up of the decoder a STOP signal is generated in step 101 so as to cause each of the control relays 34 to be placed in a desired initial state. The microcomputer then enters a routine identified as BEGIN. In step 102, a register dedicated for use as a pointer, which is hereinafter referred to as the POINTER register, is set to a predetermined initial value. Also, a second dedicated register, referred to hereinafter as the NUMBER register, is reset to zero. In the next step 103, a register referred to hereinafter as the COUNTER register is reset to zero. In the next step 104, the presence or absence of an encoded signal is detected, as indicated by receipt of a pulse from the receiver 14. If a pulse is detected, the microcomputer enters a subroutine denoted DELAY (step 105), in which the count in the COUNTER register is incremented by one after the elapse of 2.5 milliseconds. After each increment, a determination is made in step 106 as to whether the count in the COUNTER register is greater than a predetermined maximum count that corresponds to an unacceptably long whistle blast duration, ordinarily approximately one second. If the count is too large, then it is determined that the pulse is too long and represents an aberrant signal and a return is made to the start of the main program. If the count in the COUNTER register is not too large and the pulse is still present (as detected in step 107), the microcomputer returns to the DELAY subroutine and continues incrementing the count in the COUNTER register at 2.5 millisecond intervals.

Upon termination of the pulse as detected in step 107, a determination is made in step 108 as to whether the count in the COUNTER register is too small. If the count is too small, for example, less than a predetermined minimum count corresponding to approximately 50 milliseconds, the pulse is ignored and the microcomputer returns to step 103 wherein the COUNTER register is reset to zero. This step of the program effectively prevents spurious momentary pulses from being considered as valid pulses.

Upon termination of the first pulse and after affirmative determination that the duration of the pulse as determined by the count in the COUNTER register is neither too long nor too short, the count in the COUNTER register (step 109) is stored in a memory location indicated by the current value of the POINTER register, which in the first instance is a first memory location set aside for recording of count data. A schematic representation of how the memory locations for count data are configured and sequentially loaded is shown in FIG. 7.

The POINTER and NUMBER registers are also incremented in step 109. In the first instance, the POINTER register thus will point to a second memory location for count data and the NUMBER register thus will contain a count of one. In the next step 110, a determination is made as to whether the count in the NUMBER register is too large by comparing the count with a predetermined maximum count. As can be appreciated, the count in the NUMBER register represents the number of pulses thus far received in the whistle signal. If the maximum number of whistle blasts in any standardized whistle signal is eight, the predetermined maximum count is eight.

Provided the count in the NUMBER register is not too large, the COUNTER register is reset to zero in step 111, and the duration of the ensuing space is measured in steps 112, 113 and 114. In this regard, the DELAY subroutine is again implemented in step 112. As with the pulses, there is a limit set on the maximum permissible duration of a valid space, for example, one second. If the count in the COUNTER register exceeds a predetermined maximum count corresponding to this maximum permissible duration, a determination is made in step 113 that the whistle signal has ended and the microcomputer proceeds directly to the routines shown in FIG. 5B. If the count is not too large, a determination is made in step 114 as to whether a pulse is present. As long as the count in the COUNTER register is not too large and a pulse is absent, the microcomputer continues to pass through the DELAY subroutine to increment the count in the COUNTER register at 2.5 millisecond intervals. Upon the detection of a pulse in step 114, a determination is made in step 115 so as to whether the count in the COUNTER register is too small. This determination effectively prevents the registering of spurious momentary gaps in a pulse as valid spaces. If such a spurious gap (usually less than 50 milliseconds) is detected, i.e., if the count in the COUNTER register is less than a predetermined minimum count corresponding to the spurious gap, the POINTER register is decremented (step 117) and the count in the thus-pointed memory location for count data (which is the count for the previous pulse) is stored in the COUNTER register. The function of this step in the program is to restart the timing of the previous pulse at the previous count therefor as the microcomputer returns to step 105.

Assuming that the count in the COUNTER register is not too small, i.e., that a valid interpulse space has been detected and timed, the count in the COUNTER register is stored (step 116) at the memory location indicated by the POINTER register, which for the first space is the second memory location for count data. The POINTER register is then incremented and the microcomputer returns to step 103 to begin timing the next pulse. It will be seen from the discussion thus far that as the microcomputer continues to loop through that portion of the BEGIN routine starting at step 103, the durations of successive pulses and interpulse spaces are measured and the corresponding counts are stored in successive memory locations for count data. At the same time, the count in the NUMBER register indicates the total number of pulses received.

Upon determining that a complete whistle signal has been received, by detecting an excessive number of pulses in step 110 or by detecting an excessively long space in step 113, the microcomputer enters a routine identified as TERMINATE (FIG. 5B), during the first step of which (118) registers identified as REF 1 and REF 2 are reset to zero, and a FLAG bit is reset to zero. The microcomputer then enters (step 110) a subroutine identified as REDUCE, set forth in FIGS. 6A and 6B, in which the durations of the pulses and spaces in the whistle signal are reduced to first and second digital words, respectively, representing the sequence of long and short pulses and the sequence of long and short spaces in the whistle signal.

Referring to FIG. 6A, during the first step 120 of the REDUCE subroutine the count in the COUNTER register is set to the count in the NUMBER register less the value of the FLAG bit. As will be seen from the discussion below, the count in the COUNTER register in the REDUCE subroutine is equal to the number of pulses in the signal when the pulse durations are being reduced, and is equal to the number of spaces when the space durations are being reduced. The FLAG bit can be conveniently used to set the count in the COUNTER register for either pulses or spaces since the number of spaces in any whistle signal is always exactly one less than the number of pulses. Upon the first pass of the microcomputer through the REDUCE subroutine, the count in the COUNTER register is equal to the number of pulses in the whistle signal since the FLAG bit was reset in step 118 (FIG. 5B).

The POINTER register is initialized (step 121) at a beginning value corresponding to the address of the first memory location for count data, plus the value of the FLAG bit. In the first pass of the microcomputer through the REDUCE subroutine, the POINTER register points to the first memory location which contains the count corresponding to the duration of the first pulse.

In the next step 122 of the REDUCE subroutine, a determination is made as to whether the count in the COUNTER register equals zero. Upon the first pass of the microcomputer through the REDUCE subroutine, the determination in step 122 will always be negative since there always will be at least one pulse in each whistle signal. Then, an accumulator is reset to zero (step 123) and an LRG routine is entered in which the duration of the longest pulse is determined. This is done by sequentially comparing the pulse counts stored in the memory locations with the current count in the accumulator. More specifically, if a pulse count is not less than the count in the accumulator, the determination in step 124 is negative so that the memory address in the POINTER register is stored in a register identified as R1 (step 125). Then the pulse count from the memory location pointed to by the pointer (i.e., pointed to by the address in R1) is placed in the accumulator (step 126). If a pulse count is less than the count in the accumulator, the determination in step 124 is affirmative so that the microcomputer skips step 125 and proceeds directly to step 126. The POINTER register is then incremented by two (step 127) so as to skip the next memory location and to point to the memory location containing the count of the next pulse. Also, the count in the COUNTER register is decremented by one. A determination is then made in step 128 as to whether the count in the COUNTER register is zero. If not, the microcomputer returns to step 124 and compares the next pulse count with the count in the accumulator. The microcomputer thereafter continues to loop through that portion of the LRG routine including steps 124, 125, 126, 127 and 128 until all pulse counts have been compared and the count in the COUNTER register is zero. At this time, the count in the accumulator is stored in a register denoted R4 (step 129). RegisterR4 thus contains a count corresponding to the duration of the longest pulse in the whistle signal.

The microcomputer then reinitializes the COUNTER and POINTER registers in steps 130 and 131. As before, the count in the COUNTER register is set to the count in the NUMBER register less the FLAG bit, which in the first pass is equal to zero. Likewise, the POINTER register is set to its beginning value plus the value of the flag bit. Thus, in the first pass the POINTER register again points to the first memory location. In the next step 132 the accumulator is set to its maximum count.

Thereafter, the microcomputer enters a SML routine in which the duration of the shortest pulse is determined. In step 133, the count in the memory location pointed to by the POINTER register, which corresponds in the first instance to the duration of the first pulse, is compared with the count in the accumulator. If the count in the first memory location is less than that in the accumulator, the microcomputer proceeds in step 134 to store the memory address in the POINTER register in register R1. In the first instance, register R1 will therefore contain the memory address for the first memory location. In the next step 135 the count in the first memory location is loaded into the accumulator. In the next step 136, the POINTER register is incremented by two to point to the memory location for the next pulse count, and the COUNTER register is decremented by one. A check is made in step 137 to determine whether the count in the COUNTER register is zero. If not, additional pulse counts need to be compared and the microcomputer continues to loop through that portion of the SML routine that has been described until all pulse counts have been compared and the count in the COUNTER register is zero. The count representing the duration of the shortest pulse is then loaded into the accumulator in step 138.

At this time, the accumulator contains a count representing the duration of the shortest signal pulse and register R4 contains a count representing the duration of the longest pulse. These counts are compared in succeeding steps to determine whether the whistle signal consists of both long and short whistle blasts, or consists of a sequence of blasts which although they may vary somewhat in duration, are intended to represent a sequence of blasts of uniform duration. In this regard, it is noted that it is sometimes difficult to determine whether a sequence of whistle blasts of uniform length is intended to represent a sequence of short blasts or a sequence of long blasts. However, in the logging industry, there is no standardized whistle signal corresponding to a sequence of long whistle blasts, so that if a sequence of uniform whistle blasts is detected it can safely be assumed to represent a sequence of short whistle blasts.

In step 139, the count in the accumulator is multiplied by two. A determination is then made in step 140 (FIG. 6B) as to whether the count in the accumulator is too large, i.e., as to whether the accumulator has overflowed. If so, it is determined that all pulses in the whistle signal are short so that the microcomputer resets register R1 to zero (step 140A) and returns to its main program.

If the count in the accumulator is not too large, the count in the accumulator is then compared with the count in register R4 in step 141. If the count in the accumulator is greater than that in register R4, then the shortest pulse is more than half as long as the longest pulse. In this situation, it is assumed that there is not a significant difference between the durations of the whistle blasts and that the whistle signal accordingly consists of a sequence of short whistle blasts, so that the microcomputer returns to the main program after first resetting register R1 in step 140A.

If the count in the accumulator is not greater than the count in register R4, then it is assumed that there are both long and short pulses in the whistle signal and in the next step 142 the average of the longest pulse duration (the count in register R4) and the shortest pulse duration (the count in the memory location whose memory address is in register R1) is determined. This average pulse duration (or count) is loaded into register R4 and is used in the ensuing steps to discriminate between long and short pulses.

In the next steps 143 and 144, the COUNTER and POINTER registers are again reinitialized, and in the next step 145, the register R1 is reset to zero. The microcomputer then enters a routine identified as ASMBL wherein a first or "pulse" digital word representing the sequence of long and short pulses in the whistle signal is assembled.

An inquiry is made in step 146 as to whether the count in the memory location pointed to by the POINTER register is greater or less than the count in register R4, i.e., whether the first pulse is a long or a short pulse. If the determination in step 146 is affirmative, the count in register R1 is incremented by one in step 147. If the determination in step 146 is negative, the count in register R1 is unchanged. Therefore, if the first pulse is a long pulse, the rightmost location in register R1 contains a one, and if the first pulse is a short pulse, the rightmost location in register R1 contains a zero. The count in register R1 is then shifted left by one position in step 148. In the event that the first pulse is a long pulse, register R1 will therefore contain "10", and in the event that the first pulse is a short pulse, register R1 will therefore contain "00". Also in step 148, the POINTER register is incremented by two to point to the memory location for the next pulse count and the COUNTER register is decremented by one. A determination is then made in step 149 as to whether the count in the COUNTER register is zero. If not, additional pulse counts need to be classified and the microcomputer continues to loop through the ASMBL routine until all pulse counts have been classified and the count in the COUNTER register is zero. At this time, the count in register R1 comprises a pulse word that is right-justified and that represents the sequence of long and short pulses in the whistle signal, with a one representing a long pulse and a zero representing a short pulse. An exemplary pulse word for the whistle signal illustrated in FIG. 2 which consists of a long blast, a short blast, two long blasts, and a short blast is accordingly "00010110", assuming that register R1 is an eight-bit register. Thereafter, the microcomputer returns to the main program.

When the microcomputer exits from the REDUCE subroutine in step 119 (FIG. 5B) and then proceeds to step 150, it should be noted that the pulse word in register RI contains either all zeroes (in the event that the whistle signal is invalid or in the event that all pulses in the whistle signal are short) or a sequence of ones and zeroes (in the event that at least one pulse in the whistle signal is long). In step 150, the pulse word in register R1 is stored in a memory location identified as REF 1 (as shown in FIG. 8 for the whistle signal in FIG. 2) and the FLAG bit is complemented (i.e., set to one). Thereafter, the microcomputer again proceeds in step 151 to enter the REDUCE subroutine. During this second pass through the REDUCE subroutine, the duration of the longest space is determined, the duration of the shortest space is determined, and these durations (represented respectively by counts in the accumulator and in register R4) are compared to determine if there is a significant difference between these durations. If a significant difference is determined, then it is noted that both interpulse spaces (short spaces) and pauses (long spaces) are present in the whistle signal. The average space duration is then determined and the space durations are classified as either long or short by comparing them with the average space duration. Once having classified the space durations, a second digital or "space" word is assembled in register R1 that represents the sequence of long and short spaces in the whistle signal.

Although the operation of the microcomputer when passing through the REDUCE subroutine in step 151 is similar to that previously described for step 119, the following differences should be noted. First, the count in the COUNTER register is set to the count in the NUMBER register less the value of the FLAG bit in step 120. Since the FLAG bit has now been set (in step 150) the count in the COUNTER register is therefore equal to the number of spaces in the whistle signal. In step 121, the POINTER register is initialized at a beginning value corresponding to the address of the first memory location for count data, plus the value of the FLAG bit. Since the FLAG bit has now been set, the POINTER register points to the second memory location which contains the count corresponding to the duration of the first space (if any). If the whistle signal contains a single pulse, the determination in step 122 is affirmative (i.e., there are no spaces) whereby register R1 is reset to zero in step 122A (so that the space word therein includes all zeros) and the microcomputer thereafter returns to its main program. Second, the count in the accumulator (which is the count of the shortest space) is multiplied by two in step 139. A determination is then made in step 140 (FIG. 6B) as to whether the count in the accumulator is too large. If so, it is determined that all spaces in the whistle signal are short so that the microcomputer resets register R1 to zero (step 140A) and returns to its main program. If the count in the accumulator is not too large, the count in the accumulator is then compared with the count in register R4 (which is the count of the longest space) in step 141. If the count in the accumulator is greater than that in register R4, then the shortest space is more than half as long as the longest space. In this situation, it is assumed that there is not a significant difference between the durations of the spaces and that the whistle signal accordingly consists of a sequence of short spaces so that the microcomputer returns to the main program after first resetting register R1 in step 140A.

Upon exiting from its second pass through the REDUCE subroutine in step 151, the microcomputer then (step 152) stores the space word in register R1 in a memory location identified as REF 2. For the whistle signal illustrated in FIG. 2 in which there are two short spaces, a long space, and a short space, the space word accordingly stored in REF 2 is "00000010" as illustrated in FIG. 8.

When the microcomputer has stored the pulse and space words in REF 1 and REF 2, respectively, the microcomputer enters a subroutine identified as CORRELATE in which the pulse and space words and the count in the NUMBER register are compared with corresponding reference words in a look-up table stored in the data memory. In the preferred embodiment, there are four successive entries in the look-up table for each output control signal (see FIG. 9). The first and second entries contain reference pulse and space words, the third entry contains a reference number representing the number of pulses in the reference pulse word in the first entry, and the fourth entry contains an address in the data memory at which will be found an instruction which when executed causes the microcomputer to supply the corresponding output control signal to the control relays.

In step 153 of the CORRELATE subroutine, a count is stored in register R4 corresponding to the number of output control signals in the look-up table. Also, the POINTER register is loaded with the address of the first entry in the look-up table (which will be the address containing the first reference pulseword). In the next step 154, the pulse word in REF 1 is compared with the reference pulse word thus addressed. If there is a match, the POINTER register is incremented (step 155) to the second entry and the space word in REF 2 is compared (step 156) with the reference space word thus addressed. If there is a match, the POINTER register is again incremented (step 157) and the count in the NUMBER register is compared (step 158) with the reference number thus addressed. If there is a match, the POINTER register is again incremented (step 159) to the fourth entry which contains the address in the data memory for the instruction for the corresponding output control signal. That instruction is executed by the microcomputer in step 160 wherein the corresponding output signal is provided to control relays 34 and thus to the controlled device and the performance of the controlled device in providing the required control actions is monitored by detecting the signals on feedback connections 26. After execution of the instruction, the microcomputer returns to the BEGIN routine (FIG. 5A) and awaits another whistle signal.

If no match is found between the pulse word in REF 1 and the reference pulse word in the first entry in the table for an output control signal, then the POINTER register is incremented three times in steps 161, 162 and 163 to point to the first entry for the next output control signal in the table and the count in register R4 is decremented. Likewise, if no match is found between either the space word in REF 2 with the reference space word in the second entry or the count in the NUMBER register with the reference number in the third entry, the POINTER register is incremented an appropriate number of times to point to the first entry for the next output control signal in the table and the count in register R4 is decremented.

Each time the count in register R4 is decremented, a determination is made (step 164) as to whether the count in register R4 is zero. If the determination in step 164 is negative, the entire look-up table has not been searched and the microcomputer continues to return to and loop through that portion of the CORRELATE subroutine starting at step 154 until a complete match is found. If no complete match is found after the entire look-up table has been searched, the determination in step 164 is affirmative and the microcomputer returns to the BEGIN routine without providing any output control signal.

It will be appreciated that the system just described effectively converts whistle signals generated by a worker in the field to output control signals that control various functions of a remotely controlled device. The system accommodates ordinary human variation in the duration of the whistle blasts as well as the intervening gaps between such blasts, yet nevertheless rejects whistle signals that are unreasonably inconsistent with whistle signals as they are generally recognized in the field. For example, any whistle blast that is either too short or too long is rejected, as is any intervening gap that is either too short or too long. Nevertheless, the system is capable of accommodating substantial variation between the lengths of short and long whistle blasts as well as the lengths of short and long intervening spaces.

Although the present invention is described by reference to a preferred embodiment, it will be understood that various modifications, alterations and substitutions can be made without departing from the spirit of the invention. Accordingly, the scope of the invention is defined by the following claims.

The embodiments of the invention in which an exclusive property or privilege is claimed are defined as follows:

1. A remote control system comprising:

transmitting means for transmitting a manually encoded signal consisting of a sequence of pulses and interpulse spaces;

receiving means for receiving said manually encoded signal; and, decoding means for decoding the manually encoded signal received by said receiving means, said decoding means including first means for determining the duration of each pulse and each interpulse space, second means for digitizing the duration of each pulse and each interpulse space so as to form a digital representation of said manually encoded signal, third means for correlating said digital representation with a plurality of reference digital representations each corresponding to one of a plurality of predetermined output control signals and for selecting one of said output control signals upon determination of a match between said digital representation and one of said plurality of reference digital representations, and, fourth means for supplying said selected output control signal to a controlled device.

2. The remote control system defined in claim 1 wherein said second means classifies said pulses and said spaces into long and short pulses and long and short spaces and forms said digital representation as consisting of a digital sequence representing the sequence of long and short pulses in said manually encoded signal and a digital sequence representing the sequence of long and short spaces in said manually encoded signal.

3. The remote control system defined in claim 2 wherein said second means determines the durations of the longest and shortest pulses in said manually encoded signal and determines the average pulse duration thereof, and wherein said second means classifies said pulses into long and short pulses by comparing the duration of each pulse with said average pulse duration.

4. The remote control system defined in claims 2 or 3 wherein said second means determines the durations of the longest and shortest spaces in said manually encoded signal and determines the average space duration thereof, and wherein said second means classifies said spaces into long and short spaces by comparing the duration of each space with said average space duration.

5. The remote control system defined in claim 3 wherein said second means further determines whether the duration of the longest pulse is greater than the duration of the shortest pulse by more than a predetermined amount and classifies said pulses as being of uniform duration in the event that the duration of the longest pulse is not greater than the duration of the shortest pulse by said predetermined amount.

6. The remote control system defined in claim 2 wherein said digital representation includes a set of three digital words, a first one of said digital words consisting of a sequence of bits representing the sequence of long and short pulses in said manually encoded signal, a second one of said digital words consisting of a sequence of bits representing the sequence of long and short spaces in said manually encoded signal, and a third one of said digital words representing the number of pulses in said manually encoded signal.

7. The remote control system defined in claim 6 wherein each of said plurality of reference digital representations includes a set of three reference digital words, a first one of said reference digital words consisting of a sequence of bits representing a sequence of long and short pulses, a second one of said reference digital words consisting of a sequence of bits representing a sequence of long and short spaces, and a third one of said reference digital words representing a number of pulses, and wherein said third means successively compares said digital representation with said plurality of reference digital representations until a complete match is found between said set of three digital words and a set of three reference digital words.

8. The remote control system defined in claim 7 wherein each said set of three reference digital words further includes a fourth reference digital word representing the corresponding output control signal and wherein said third means is operative to select the corresponding output signal represented by said fourth reference digital word in a set upon determination of a complete match between said three digital words and the three reference digital words in that set.

9. The remote control system defined in claim 1 wherein said manually encoded signal is a whistle signal used in the logging industry and wherein said plurality of reference digital representations consist of standardized whistle signals used in the logging industry.

10. The remote control system defined in claim 9 wherein said transmitting means transmits said whistle signal by modulating said whistle signal on a RF carrier and wherein said receiving means receives said whistle signal by demodulating said whistle signal from said RF carrier.

11. The remote control system defined in claim 9 wherein said system further comprises audible signalling means for providing an audible signal corresponding to the whistle signal received by said receiving means.

12. The remote control system defined in claim 1 wherein said first means, said second means and said third means are incorporated in a digital computer and wherein their respective timing, digitizing and correlating functions are executed by said computer under program control.

13. A decoding means for decoding a manually encoded signal consisting of a sequence of pulses and interpulse spaces, said decoding means including first means for determining the duration of each pulse and each interpulse space, second means for digitizing the durations of each pulse and each interpulse space so as to form a digital representation of said manually encoded signal, and third means for correlating said digital representation with a plurality of reference digital representations each corresponding to one of a plurality of predetermined decoder output signals and for selecting one of said decoder output signals upon determination of a match between said digital representation and one of said plurality of reference digital representations.

14. The decoding means defined in claim 13 wherein said second means classifies said pulses and said spaces into long and short pulses and long and short spaces and forms said digital representation as consisting of a digital sequence representing the sequence of long and short pulses in said manually encoded signal and a digital sequence representing the sequence of long and short spaces in said manually encoded signal.

15. The decoding means defined in claim 14 wherein said second means determines the durations of the longest and shortest pulses in said manually encoded signal and determines the average pulse duration thereof, and wherein said second means classifies said pulses into long and short pulses by comparing the duration of each pulse with said average pulse duration.

16. The decoding means defined in claims 14 or 15 wherein said second means determines the duration of the longest and shortest spaces in said manually encoded signal and determines the average space duration thereof, and wherein said second means classifies said spaces into long and short spaces by comparing the duration of each space with average space duration.

17. The decoding means defined in claim 14 wherein said second means further determines whether the duration of the longest pulse is greater than the duration of the shortest pulse by more than a predetermined amount and classifies said pulses as being of uniform duration in the event that the duration of the longest pulse is not greater than the duration of the shortest pulse by said predetermined amount.

18. The decoding means defined in claim 14 wherein said digital representation includes a set of three digital words, a first one of said digital words consisting of a sequence of bits representing the sequence of long and short pulses in said manually encoded signal, a second one of said digital words consisting of a sequence of bits representing the sequence of long and short pulses in said manually encoded signal, and a third one of said digital words representing the number of pulses in said manually encoded signal.

19. The decoding means defined in claim 18 wherein each of said plurality of reference digital representations includes a set of three reference digital words, a first one of said reference digital words consisting of a sequence of bits representing a sequence of long and short pulses, a second one of said reference digital words consisting of a sequence of bits representing a sequence of long and short spaces, and a third one of said reference digital words representing a number of pulses, and wherein said third means successively compares said digital representation with said plurality of reference digital representations until a complete match is found between said set of three digital words and a set of three reference digital words.

20. The decoding means defined in claim 13 wherein said manually encoded signal is a whistle signal used in the logging industry and wherein said plurality of reference digital representations consist of standardized whistle signals used in the logging industry.

* * * * *